US009403656B2

(12) United States Patent
Sloupensky et al.

(10) Patent No.: US 9,403,656 B2
(45) Date of Patent: Aug. 2, 2016

(54) DRUM INTER-STORAGE OF YARN AT AN OPERATING UNIT OF A TEXTILE MACHINE AND METHOD OF CONTROL FOR

(71) Applicant: Rieter CZ s.r.o., Usti nad Orlici (CZ)

(72) Inventors: Jiri Sloupensky, Usti nad Orlici (CZ); Vladimir Kluson, Dolni Ujezd (CZ); Evzen Pilar, Litomysl (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 459 days.

(21) Appl. No.: 13/940,402

(22) Filed: Jul. 12, 2013

(65) Prior Publication Data

US 2014/0034770 A1 Feb. 6, 2014

(51) Int. Cl.

| | |
|---|---|
| ***B65H 59/18*** | (2006.01) |
| ***B65H 51/22*** | (2006.01) |
| ***D01H 13/10*** | (2006.01) |

(52) U.S. Cl.

CPC ..... *B65H 59/18* (2013.01); *B65H 51/22* (2013.01); *D01H 13/10* (2013.01); *D01H 13/104* (2013.01); *D01H 13/108* (2013.01); *B65H 2701/31* (2013.01)

(58) Field of Classification Search

CPC ..... B65H 51/02; B65H 51/20; B65H 51/22; B65H 59/10; B65H 59/18; B65H 2701/31; D01H 13/10; D01H 13/104; D01H 13/108

See application file for complete search history.

(56) References Cited

U.S. PATENT DOCUMENTS

| | | | |
|---|---|---|---|
| 3,360,212 | A | 12/1967 | Frisch |
| 3,749,327 | A | 7/1973 | Roethke et al. |
| 3,924,818 | A | 12/1975 | Pfeifle |
| 4,044,962 | A | 8/1977 | Calamani et al. |
| 4,106,712 | A | 8/1978 | Savio et al. |
| 4,153,214 | A | 5/1979 | Savio et al. |
| 4,553,709 | A | 11/1985 | Bock et al. |
| 4,558,265 | A | 12/1985 | Hayashida et al. |
| 5,160,097 | A | 11/1992 | Josefsson et al. |

FOREIGN PATENT DOCUMENTS

| | | | |
|---|---|---|---|
| CS | 237357 | | 7/1985 |
| DE | 25 53 892 | | 6/1977 |
| DE | 27 17 314 | | 11/1978 |
| DE | 34 15 447 | A1 | 1/1985 |
| EP | 1457448 | | 9/2004 |
| EP | 1 598 295 | A1 | 11/2005 |
| EP | 1717182 | | 11/2006 |
| EP | 2 075 359 | A2 | 7/2009 |
| EP | 2075358 | | 7/2009 |
| EP | 2 284 300 | A1 | 2/2011 |

OTHER PUBLICATIONS

EP Search Report, Jun. 24, 2014.
Czech Republic Search Report, Feb. 14, 2013.

*Primary Examiner* — William E Dondero
(74) *Attorney, Agent, or Firm* — Dority & Manning, P.A.

(57) ABSTRACT

A drum inter-storage of yarn for a textile machine includes a driven rotary drum (10) with a compensatory rotary arm (103). The rotary drum (10) is coupled with a first drive formed by an electric motor, and a compensatory rotary arm (103) is coupled with a second drive formed by an electric motor, whereby both motors are connected to a control device. The invention also relates to a method of controlling the drum inter-storage (1) of yarn at an operating unit of a textile machine.

9 Claims, 4 Drawing Sheets

DRUM INTER-STORAGE OF YARN AT AN OPERATING UNIT OF A TEXTILE MACHINE AND METHOD OF CONTROL FOR

TECHNICAL FIELD

The invention relates to a drum inter-storage of yarn for a textile machine, which comprises a driven rotary drum with a movable compensatory rotary arm.

The invention also relates to a method of controlling a drum inter-storage of yarn at an operating unit of a textile machine, where the operating unit comprises a spinning unit for staple yarn production and a winding device for winding the produced yarn on a cross bobbin, whereby between the spinning unit and the winding device is arranged a draw-off mechanism for yarn from the spinning unit, and between the draw-off mechanism and the winding device is arranged a drum inter-storage for yarn with a driven rotary drum and a movable compensatory rotary arm.

BACKGROUND

In the devices for drawing-off and winding yarn of an open-end spinning machine, it is problematic to meet all the technological requirements for formation of a cross wound cylindrical and particularly a conical bobbin, and also to provide a simple construction of the machine with regard to the process of spinning-in yarn. On an open-end spinning machine, yarn is produced in the rotor of the spinning unit and is drawn-off by a pair of draw-off rollers, from which the yarn is led to a bobbin, which is leaning against a winding roller with yarn distribution. However, during the cross winding of the yarn on the bobbin, while the yarn is distributed from one extreme position to another, different length of the yarn travel path arises and therefore the yarn is wound under unequal tension.

DE 20 56 593 describes a modification of a mechanical rotary storage positioned between the draw-off rollers and the winding roller, wherein the yarn drawn-off by draw-off rollers was at first wound on a mechanical rotary storage, from which it was then drawn-off by the winding roller. In the case of a yarn rupture in the rotor, the direction of the movement of the draw-off rollers was reversed, or the direction of the movement of the mechanical rotary storage and the winding roller was reversed as well. However, the whole device was relatively costly and constructionally complicated both in respect of the construction of the machine itself, and in respect of its controlling during spinning-in or eliminating ruptures at individual spinning units.

DE 25 53 892 shows a mechanical rotary storage arranged directly above the spinning units, thus replacing draw-off rollers. The yarn from the produced storage on the mechanical rotary storage is both spun-in, i.e. taken back to the rotor, and wound on the bobbin.

DE 27 17 314 discloses a mechanical rotary storage of yarn, which is placed directly behind the draw-off rollers and is arranged on a swinging lever of a pressure roller, with which it is connected by means of a belt. Between the mechanical rotary storage and the draw-off rollers, additional yarn storage is produced in the form of a loop on the swinging lever, which is used in the event of a yarn rupture in order to put the yarn back quickly to the rotor after the pressure roller is moved away from the driven draw-off roller.

Textile machines described in CS 237357 and other documents are equipped with an inter-storage of yarn arranged at an operating unit in the yarn travel path between a spinning unit and a yarn winding unit. The subject matter of these systems is eliminating problems in the process of drawing-off and winding, as well as returning the yarn during spinning-in on an open-end spinning machine, equipped with a mechanical rotary storage behind the draw-off rollers. The principle of the solution consists in that the mechanical rotary storage is coupled with one draw-off roller, which is followed by a winding roller with yarn distribution and is fixed coaxially to the driven draw-off roller from its front side. Moreover, both behind the driven draw-off roller, and before the mechanical rotary storage, there is an output guiding means for guiding the yarn from the cylindrical surface of the driven draw-off roller into the circumferential surface of the mechanical rotary storage.

Other similar mechanisms are known, for example, from the documents CS 198 164; CS 207 677; and CS 196 204.

From EP 1 457 448; EP 1 717 182; and EP 2 075 358 are also known air-jet spinning machines with a drum inter-storage of yarn. The air-jet spinning machine is fitted in the space between the place of producing yarn and that of winding yarn on a bobbin with a device for intermediate depositing of the yarn produced in the spinning unit. This device for intermediate depositing of the yarn is formed by a rotating body of approximately cylindrical shape with a specially moulded surface, which enables gradual slipping of the deposited yarn and its subsequent unwinding for the process of winding on a cross bobbin. For simplification, hereinafter this component will be called a drum. To the front part of the drum, from which the yarn is wound further towards the winding device, is aligned a rotating arm fitted with a catching member for yarn, which during the arm rotation, moves in the vicinity of the outer circumference of the front part of the drum, partly reaching as far as above the end surface of the front part of the drum. The rotating arm is radially mounted on a rotary shaft, which is concentric with the axis of the shaft of the rotating cylindrical body with which it has a common axis of rotation. Between the rotating cylindrical body and the shaft of the arm there is formed force transfer of the torque from the drum to the arm shaft, for example, the force transfer of the torque is formed by magnetic or electromagnetic power acting between the drum and the arm shaft, or the force transfer of the torque is formed by means of friction contact between the drum and the arm shaft, i.e. down-pressure of the surfaces is induced between an appropriate part of the drum and an appropriate part of the arm shaft. By virtue of this down-pressure between the engaging surfaces of the drum and the arm shaft during the drum rotation, friction force arises, transferring the torque from the driven drum to the towed shaft of the arm, which, as a result of that, begins to rotate in the same direction as is the direction of the driven drum rotation. By appropriate setting of either the mechanical friction clutch or the magnetic or electromagnetic clutch, it is possible to achieve the state when the force transfer between the drum and the shaft of the arm is restricted upon attaining a specific torque corresponding to the desired tension in the drawn-off and wound yarn and, as a consequence, the yarn is unwound from the storage under a predefined tension. Due to the principle of the torque transfer between the drum and the arm, which is in actual fact a "master-slave" type, the arm can only rotate actively in the direction of the drum rotation, and at such an angle speed that does not exceed the speed of the drum rotation. However, the arm can never actively and independently rotate at a speed that would be higher than that of the drum rotation, nor can it actively—without the unwound yarn acting upon it—rotate in the direction opposite to that of the drum rotation.

To the entire mechanism designed for the purpose of intermediate storage of yarn is further assigned a movable guide plate that can move between extended and retracted positions and which comprises a yarn guide device. The guide plate in its extended position leads the yarn outside the area in which the yarn could be catched by the arm, rotating freely in synchrony with the drum rotation, and thus led onto the drum. It is only in this situation that the drum can stand still and not rotate. In the retracted position of the guide plate, the yarn is led by the guide plate through the area in which the yarn intersects the travel path of the catching end of the arm and, consequently, the drive of the drum is started and the drum rotates. Simultaneously, the torque is transferred by the above-mentioned connection "master-slave" from the drum on the arm, which also rotates as a result of it, so that the catching end of the arm catches the yarn, leading it onto the rotating drum, over which the yarn further winds between the area of the yarn delivery and the area of yarn outlet, whereby the free yarn is eliminated by extending the length of the yarn travel path by wrapping it around the rotating drum. At the same time, during winding yarn over the rotating drum, the arm acts upon the yarn by a specific force which corresponds to the amount of the tension in the yarn and the set value of the force coupling for the transfer of the torque from the drum to the arm, whereby the yarn tension becomes stabilized for winding on a cross bobbin. According to the level of the tension acting in the yarn and according to the set stage of transfer of the torque between the arm and the rotating drum, the arm supports the winding of the yarn onto the rotating drum, or, conversely, supports the unwinding of the yarn from the rotating drum, namely when compensating for changes of tension in the yarn.

A disadvantage of these well-known mechanisms is the relatively demanding setting of the correct magnetic, electromagnetic or friction coupling, i.e. transfer of the torque between the rotating drum and the arm, as well as connection of this demanding setting to other cooperating parts of the textile machine that are placed in the travel path of the yarn before the inter-storage and behind it. It is also problematic to achieve long-term stability and repeatability of the setting of the coupling for the transfer of the torque between the drum and the arm, especially at different operating units of the spinning machine. Another drawback of these embodiments is the fact that the arm is incapable of attaining higher speeds of rotation than the speed of the rotating drum, as well as the fact that without the impact of the draw in the yarn (tension), the arm must always rotate in the direction of the drum rotation. Another disadvantage of this embodiment is the necessity of using a controlled movable guide plate or another device for leading yarn either out of the travel path of the catching end of the arm or across the travel path of the catching end of the arm.

Accordingly, the goal of the present invention is to eliminate, or at least minimize, the disadvantages of the prior state of the art, for example the necessity of the consequent transfer of the torque from the rotating drum to the arm, enable the arm to move independently in both directions of rotation, regardless of the speed of the drum rotation, enable the implementation of the central electronic setting of the parameters of the arm, such as the speed and the generated torque, eliminate the necessity of using a movable guide plate of yarn and, on the whole, improve the dynamic response of the entire system.

PRINCIPLE OF THE INVENTION

Additional objects and advantages of the invention will be set forth in part in the following description, or may be obvious from the description, or may be learned through practice of the invention.

The objective of the invention has been achieved by a drum inter-storage for yarn, whose principle consists of a driven rotary drum coupled with a first drive formed by an electric motor, and a compensatory rotary arm coupled with a second drive formed by an electric motor, whereby both the motors are connectable to the controlling system of the spinning machine.

The advantage of this solution is that the rotary arm is driven by an independent drive, which is by means of the controlling system of the machine controlled in such a manner that the speed of the arm and the generated torque are, in case of need, independently controllable, regardless of the speed and direction of the rotation of the working surface of the inter-storage (the drum), which results in a wider potential of using the storage during automation of attending operations at an operating unit of a textile machine being automated.

The principle of the method of controlling the drum inter-storage of yarn at an operating unit of a textile machine consists in that the rotation of the compensatory rotary arm with its own motor is controlled according to the rotation of the drive of the drum in such a manner that during continuous spinning a constant torque is developed on the yarn for creating required yarn tension for winding the yarn on a cross bobbin and upon transition from continuous spinning to intermediate state, the speed and the torque of the compensatory rotary arm are controlled at least partly independently of the speed of the drum rotation.

DESCRIPTION OF DRAWINGS

The present invention is schematically shown in the drawings, where.

SPECIFIC DESCRIPTION

Figure 1:
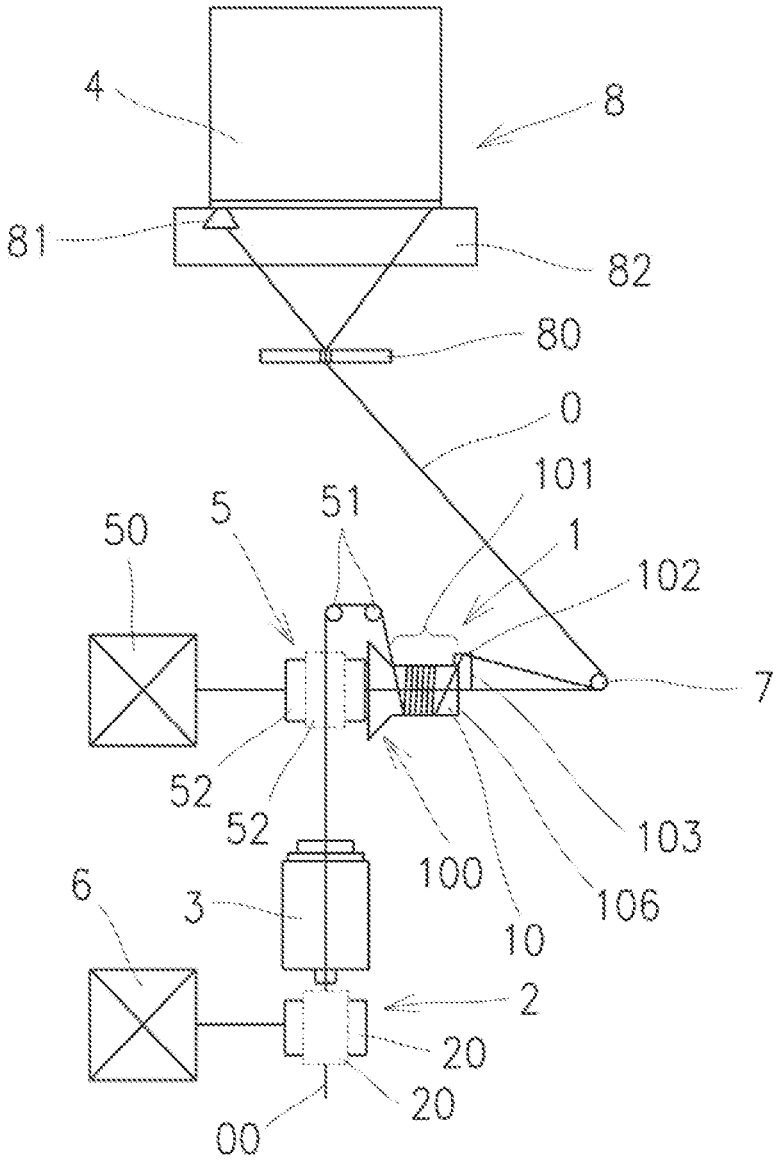
FIG. 1 shows one possible arrangement of an operating unit of a textile machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Referring to FIG. 1, the drum inter-storage for yarn is applied at an operating unit of a textile machine with at least one operating unit, at which are arranged individual devices for yarn 0 formation from staple fibers, for example from staple fibres 00, arranged in the form of a sliver or fibre band etc., and for subsequent winding of the produced yarn 0 on a bobbin 4.

Staple fibres 00 are delivered to a feeding device 2 from an unillustrated storage device, for example from a sliver can. The feeding device 2 provides feeding of the required amount of staple fibres 00 into the spinning unit 3, arranged further. The feeding device 2 has a suitable construction according to the type of the used spinning unit 3. If the spinning unit 3 with a spinning nozzle is used, the feeding device 2 is usually formed by a pair of feeding rollers 20, whereby at least one of them is driven by a drive 6 connected to a source of energy and the controlling device. Moreover, such a feeding device 2 can be preceded by a suitable device for pre-preparation of fibre material, for instance a drafting mechanism etc. If the spinning unit 3 with a spinning rotor is used, the feeding device 2 is generally composed of a set of a feeding roller and a feeding table, to which a singling-out device of fibres with a combing roller is assigned, whereby the singling-out device, which is usually connected to a system of withdrawal of impurity from the fibre material, is followed by a transport channel of fibres leading to the spinning rotor. In the spinning unit 3, staple fibres 00 are twisted to create yarn 0, which is drawn-off from the spinning unit 3 by a draw-off mechanism 5. The draw-off mechanism 5 usually consists of a pair of draw-off rollers 52, only one of which is driven by a connected drive 50, which is connected to a source of energy and a controlling device.

The drum inter-storage 1 for yarn 0 is situated in the direction of the movement of yarn 0 behind the draw-off mechanism 5, whereby in the travel path of the yarn 0 between the draw-off mechanism 5 and the drum inter-storage 1 is arranged a guiding means 51 for yarn 0 from the draw-off mechanism 5 to the working surface of the drum 10 of the drum inter-storage 1.

The drum inter-storage 1 comprises a pivotably seated drum 10, which is coupled with a drive connected to a source of energy and a controlling device. The drum inter-storage 1 is, by the inlet portion 100 of its drum 10, forward sloping to the guiding means 51 and to the draw-off mechanism 5. To the outlet portion 106 of the drum 10 of the drum inter-storage 1 is aligned an output guidance means 7 of yarn 0 from the working surface of the drum 10 of the drum inter-storage 1 to the winding device 8 of yarn 0, arranged further in the direction of the movement of yarn 0.

The inlet portion 100 of the drum 10 is made as a conical surface sloping away from the draw-off mechanism 5 towards further arranged central portion 101 of the drum 10. From the central portion 101 of the drum 10, the yarn 0 continues to the outlet portion 106 of the drum, where it passes through the working travel path of the independently driven movable arm 103 with a guide 102 for yarn 0 running around the outer circumference of the outlet portion 106 of the drum 10, which acts upon the yarn 0 in a defined manner, as will be described further on.

Figure 2:
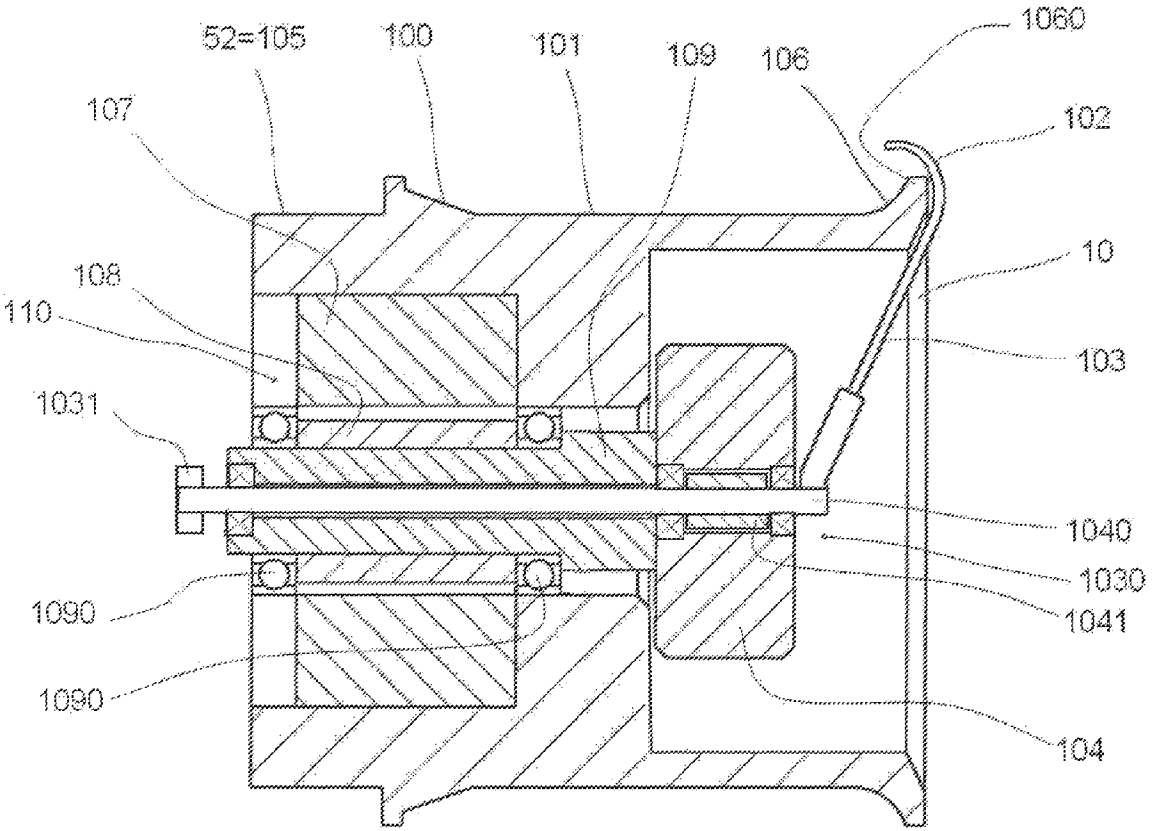
FIG. 2 shows a longitudinal cross-section of the arrangement of an inter-storage of yarn.

Referring to FIG. 2, the movable arm 103 with the guide 102 is mounted on a independently rotatable shaft 1040, whose axis of rotation is identical with that of the rotation of the drum 10. The independently rotatable shaft 1040 is coupled with its own drive, independent of the drive of the drum 10 and connected to a source of energy and a controlling device. That means that the drum 10 and the shaft 1040 are each driven by separate drives, which are connected to one common controlling device. Thus the independently rotatable shaft 1040 can rotate upon signals from the controlling device fully independently of the rotation of the drum 10, namely both in respect of the direction of rotation and in respect of the speed of rotation, as well as in respect of the size or the time course etc., of the generated torque and from the view point of acceleration, deceleration and other dynamic motion parameters and modes.

The drive of the independently rotatable shaft 1040, i.e. the drive of the movable arm 103, is either composed of an external drive, or it is built-in directly in the drum inter-storage 1, for example as an integrated electric motor, the rotor of which is formed by the independently rotatable shaft 1040 with a movable arm 103. The movable arm 103 forms the so-called compensatory rotary arm. In an example embodiment, the drive of the independently rotatable shaft 1040 is formed by a brushless electric motor with permanent magnets, the so-called BLDC motor. Such BLDC motor is, in one embodiment, equipped with an encoder 1031 of the position and/or speed of the rotation of the independently rotatable shaft 1040 and enables accurate control of reversible motion and to stop the independently rotatable shaft 1040 with movable arm 103 according to the commands of the controlling device and pursuant to instant need of the technological processes at an operating unit.

In the embodiment illustrated in FIG. 1, the drum 10 is situated on a common shaft with a driven draw-off roller 52 of the draw-off mechanism 5, whereby the outer diameter of the driven draw-off roller 52 and the outer diameter of the central portion 101 of the drum 10 correspond approximately to each other for the purpose of attaining mutually proximate circumferential speed of the working surface of the driven draw-off roller 52 and the circumferential speed of the central portion 101 of the drum 10 in order to generate required pre-tension in the yarn 0 for winding it on the central portion 101 of the drum 10. The central portion 101 of the drum 10 is either cylindrical, or, as is apparent from FIG. 2, slightly conical with inclination away from the inlet portion 100 of the drum 10 towards the outlet portion 106 of the drum 10, which facilitates yarn 0 delivery from the working surface of the drum 10.

In the embodiment shown in FIG. 2, the driven draw-off roller 52 is a direct part of the body of the drum 10, i.e. it is made as cylindrical surface 105, which immediately continues into the inlet portion 100 of the drum 10, whereby the drum 10 as such is coupled with a drive. The drive of the drum 10 is either formed by an external drive, for example by the drive 50 from FIG. 1, or it is composed of a special drive, built-in directly in the inner space of the drum 10 independently of the drive of the movable arm 103. For instance, the drive may be formed by BLDC motor 110, which will be described further on. In this way an integrated multi-purpose motor is made, its rotor fulfilling both the function of the driven draw-off roller 52 of the draw-off mechanism 5, and the function of the driven rotating drum 10 of the drum inter-storage 1. In the embodiment FIG. 2, the drive of the drum 10 is formed by a brushless electric motor 110 with permanent magnets, the so-called BLDC motor, whose rotor 107 is firmly connected to the drum 10 and whose stator 108 is fixedly connected to the central non-rotating shaft 109, on which the drum 10 is pivotably mounted with the aid of a pair of bearings 1090. According to an unillustrated embodiment, such BLDC motor 110 can also be equipped with an unillustrated encoder of the position of the rotor and/or the speed of the rotation of the drum 10 and enables accurate control of reversed motion and to stop the drum 10 according to the commands of the controlling system of the machine and according to instant need of the technological processes at an operating unit.

In the embodiment in FIG. 2, the independently rotatable shaft 1040 is pivotably seated in the cavity of the central non-rotating shaft 109, which is at its end section by the movable arm 103 equipped with a stator 104 of the motor 1030 of the independently rotatable shaft 1040. Through the stator 104, which is also hollow, passes the independently rotatable shaft 1040, mounted also in the stator 104 in bearings. In addition, the independently rotatable shaft 1040 carries a rotor 1041 of the BLDC motor 1030, whose stator 104 is mounted, as already mentioned above, on the central non-rotating shaft 109. With the reverse end of the independently rotatable shaft 1040, is aligned in the illustrated embodiment the above-mentioned encoder 1031 of the position and/or speed of the rotation of the independently rotatable shaft 1040.

In an unillustrated embodiment, the independently rotatable shaft 1040 is short and does not pass through the whole length of the cavity of the central non-rotating shaft 109.

The central non-rotating shaft 109 is arranged in the frame of the machine, or, as the case may be, it is fitted with means for arrangement in the frame of the machine.

As is apparent from FIG. 2, the outlet portion 106 of the drum 10 is equipped at its end with an extension 1060, which reduces or eliminates undesirable slippage of yarn 0 from the working surface of the drum 10 outside the movable arm 103.

Referring to FIG. 1, in the direction of the movement of the yarn 0, behind the movable arm 103 there is arranged the above-mentioned output guiding means 7 of yarn 0, behind which in the direction of the movement of the yarn 0 is arranged a winding device 8 of yarn 0. The winding device 8 comprises an auxiliary guide 80, which stabilizes the yarn 0 in the central portion of the width of the winding device 8. In the direction of the movement of the yarn 0 behind the auxiliary guide 80 is further arranged a yarn 0 distribution device 81 along the width of the conical bobbin 4, on which the yarn 0 winds. In the illustrated embodiment, the bobbin 4 is driven by a rotating driving roller 82, on which the bobbin 4 is situated when winding the yarn 0 and on which cross-winding is made.

The controlling device of the drive of the drum 10 and the controlling device of the movable guide 102 provides controlling both the drives in order to develop a constant torque by the movable arm 103 on the yarn 0 during continuous spinning for creating the required tension in the yarn 0 for winding the yarn 0 on the cross bobbin 4. This constant torque for continuous spinning can be centrally set for various types of yarns by means of changing parameters of the controlling system and thus the required density of yarn package on the bobbin 4 can be attained.

In intermediate states, such as a yarn rupture, removal of a defective yarn, or replacing a full bobbin with an empty tube, both the speed and the torque of the arm are controlled at least partly independently of the speed of the drum rotation. If an unillustrated yarn quality sensor detects a defect in the yarn storage on the drum, this storage can be unwound and discarded by means of the rotating arm even if the drum is not working. Upon detecting a long yarn defect, where part of the yarn is already outside the drum and is wound on a cross bobbin, this part of the defect can be rewound from the bobbin back onto the drum by means of the arm rotating reversedly and by means of reversed motion of the winding device, and subsequently it can be removed according to the preceding description.

As an electric motor for driving the arm, it is preferable to use a brushless direct-current motor with permanent magnets, the so-called BLDC motor, which can be equipped, for more accurate control, with an additional encoder of the position of the rotor and/or speed of its rotation.

In order to simplify the construction, it is advisable to place the electric motor for driving the arm directly in the drum rotation axis. So as to make the entire mechanism more simple and less costly, it is desirable to provide the drum with an individual integrated drive by an electric motor with an external rotor, which is connected to the inner surface of the drum. It is also desirable if the motor employed is a BLDC motor, i.e. a brushless motor with permanent magnets.

Figure 3:
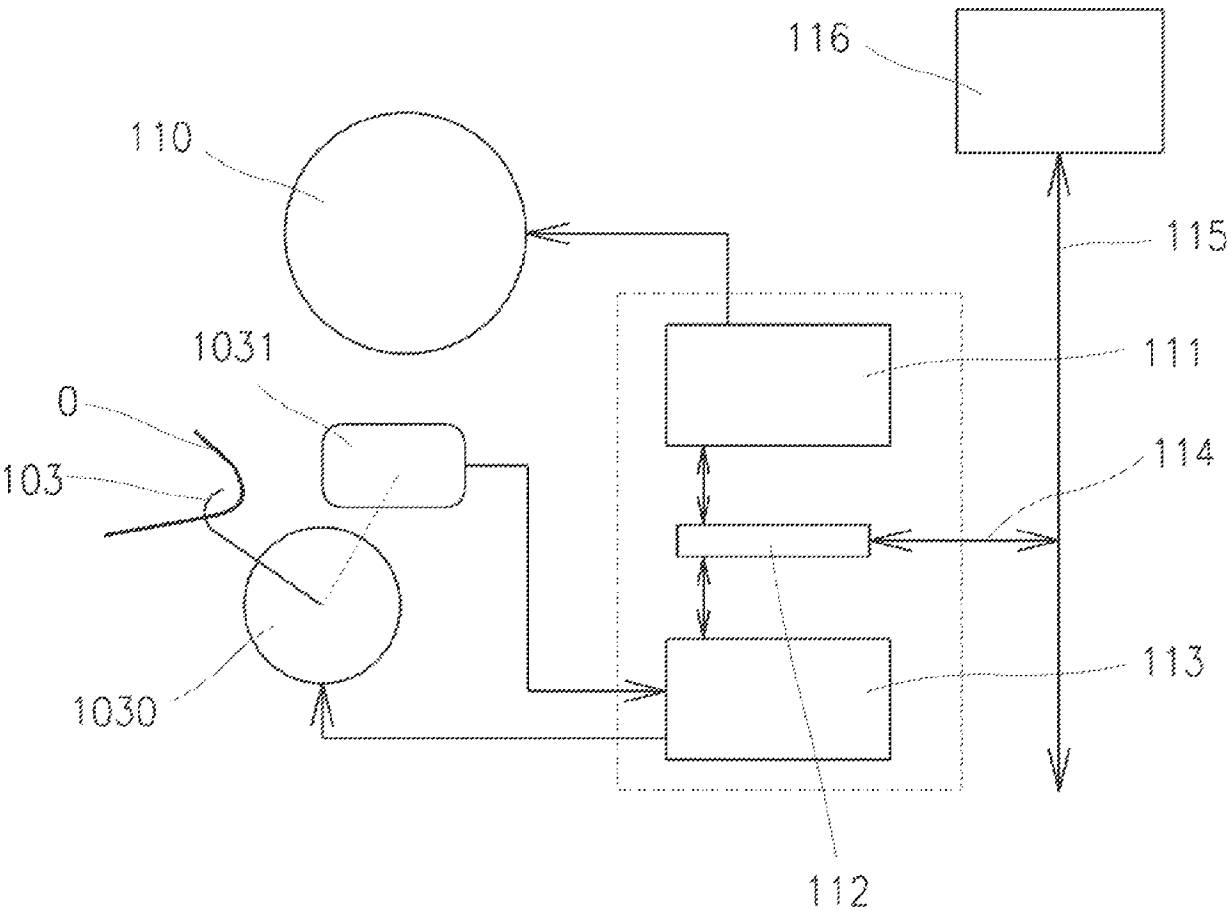
FIG. 3 shows a diagram of controlling the whole inter-storage.

In the embodiment illustrated in FIG. 3, there is a diagram of controlling the inter-storage of yarn according to the present invention. The motor 110 of the drum 10 is connected to outlet of module 111 for controlling speed of the rotation of the drum 10. The module 111 is, by a bi-directional communication conductor rail, connected to a command and communication unit 112, to which, by a bi-directional communication conductor rail, is connected module 113 for controlling the torque and/or the speed of the arm 103. To the outlet of the module 113 is connected motor 1030 of the arm 103, whereby the motor 1030 is fitted with an encoder 1031 recording, for example, angle of shifting of a shaft 104 of the arm 103, i.e. recording the angle of the shifting of shaft of the motor 1030 of the arm 103. The encoder 1031 is connected to an inlet of the module 113. The command and communication unit 112 at operating unit of the machine is, by the coupling 114, connected to the communications conductor rail 115 of the machine and further to the central control system 116 of the machine.

In the mode of continuous spinning, the torque of the motor 1030 of the arm 103 is controlled, for example, with the aid of a method of modified vector control, when two separate regulation circumferences are formed, one for monitoring and controlling the torque and the other for monitoring and controlling the magnetic flux of the motor, whereby these circumferences are formed in such a manner that they will not influence each other. The principle of this modified vector control consists in the distribution of the space vector of the stator current into two perpendicular components in the rotating coordinate system, which can be oriented to the space vector of the stator or rotor magnetic flux, or, as the case may be, to the space vector of the resulting magnetic flux. The components of the space vector of the stator current then define the torque and magnetization of the machine. The torque-generating component of the vector of the stator current, together with the respective vector of the magnetic flux, defines the motor torque. This vector control method for electric motors has been described in literature, for example in the book: Chiasson, John Nelson, Modeling and high performance control of electric machines, ISBN 0-471-68449-X.

Figure 4:
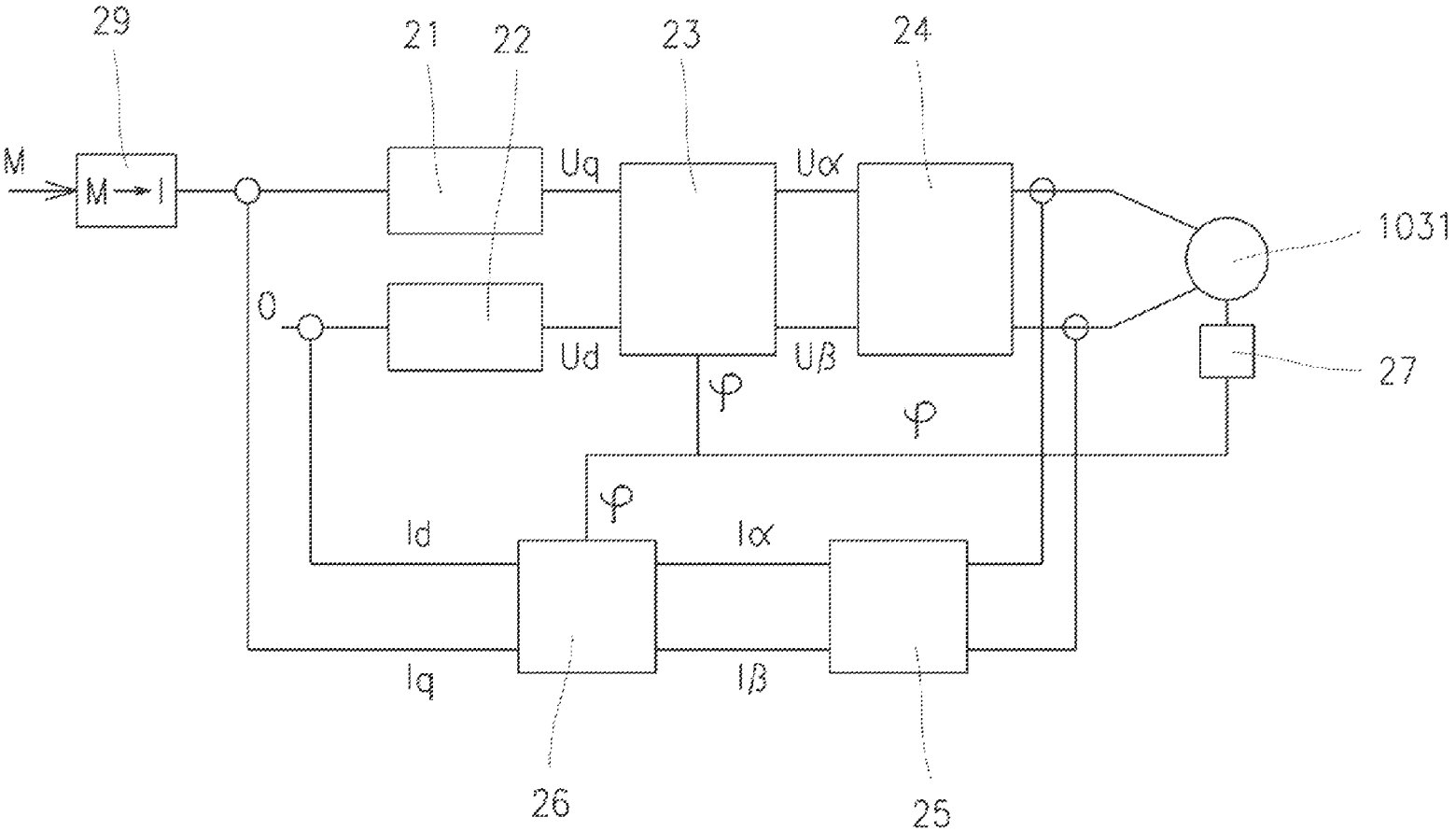
FIG. 4 shows an exemplary method of controlling the torque of the arm motor.

The arrangement of the control circumference for controlling the motor 1030 of the arm 103 in accordance with the above criteria is based, for example, on applying Park's transformation and is shown in FIG. 4. According to the type of the produced yarn and according to the type of a yarn package needed to be attained, the value of required torque M of the motor 1030 is entered in the control system, and afterwards it is, by a convertor 29, converted into the value of the electric current Iq of the motor 1030. The entered value of the electric current Iq corresponds with the required voltage Uq of the motor 1030, which is led through PI actuator 21, unit 23 of inversed Park's transformation, and PWM control module 24 to the controlled motor 1030 of the arm 103. The current Iq of the motor 1030 is, through the module 26 of Park's transformation and A/D convertor 25, supplied to the controlled motor 1030 as well. The control circumference is further fitted with a regulation branch, which is connected to the control current Id and voltage Ud. The voltage Ud is led through the second PI regulator 22 into the unit 23 of inversed Park's transformation, to PWM control module 24, and further to the controlled motor 1030 of the arm 103. The current Id flows through the module 26 of Park's transformation and A/D convertor 25 and is supplied to the controlled motor 1030 as well. From the controlled motor 1030, an encoder 1031 scans angle $\phi$ of the shifting of the shaft of the motor 1030 and this data is by feedback 27 led to the unit 23 of inversed Park's transformation and at the same time to the unit 26 of Park's transformation, and with the aid of both the units the whole system is regulated in such a manner that the current Id is zero and the current Iq amounts to the entered value torque M. Regulated values of voltage and current are supplied to the inlet of the controlled motor 1030, which develops a required torque and the arm 103 acts on the yarn 0 in the required manner.

For individual quantities in FIG. 4 the following formulas for Park's transformation are valid:

$$Id=I\alpha*\cos(\phi)+I\beta*\sin(\phi)$$

$$Iq=-I\alpha*\sin(\phi)+I\beta*\cos(\phi)$$

and for inversed Park's transformation the following formulas are valid:

$$U\alpha=Ud*\cos(\phi)-Uq*\sin(\phi)$$

$$U\beta=Ud*\sin(\phi)+Uq*\cos(\phi).$$

This method of applying Park's transformation is mentioned here merely as an example of a possible embodiment of a concrete method of controlling the motor 1030 according to the invention. However, it is apparent that those skilled in the art, using the knowledge of the principles of controlling the motor 1030, are able to find other solutions meeting the requirements for controlling the motor 1030 according to the present invention. For example, it is possible to apply direct controlling of the motor torque by means of the so-called Takahashi method according to U.S. Pat. No. 4,558,265.

It is also evident that the control circumference for controlling the motor 1030 of the arm 103, illustrated in FIG. 4, and its functions can be implemented as program blocks of the control program of the control device or controlling microprocessor.

Modifications and variations can be made to the embodiments illustrated or described herein without departing from the scope and spirit of the invention as set forth in the appended claims.

The invention claimed is:

1. A drum inter-storage for yarn in a textile machine, wherein the drum inter-storage is operably disposed between a yarn draw-off mechanism and a yarn winding device for controlling yarn tension during winding, the drum inter-storage comprising:

a driven rotary drum coupled to a first electric motor drive;

a compensatory rotary arm mounted on an independently rotatable shaft that has an axis of rotation identical to the rotary drum and that is coupled to a second electric motor drive, the compensatory rotary arm disposed to rotate and wrap drawn-off yarn around the driven rotary drum with a specific force to obtain a desired tension in the drawn-off and wound yarn;

the first electric motor drive connected to a control system and the second electric motor drive connected to the control system and independently controlled by the control system and;

wherein the control system is configured to independently rotate the compensatory rotary arm with respect to direction and speed relative to the driven rotary drum.

2. The drum inter-storage as in claim 1, wherein the second electric motor drive is a brushless motor with permanent magnets.

3. The drum inter-storage as in claim 1, wherein the second electric motor drive is arranged coaxial with an axis of rotation of the rotary drum.

4. The drum inter-storage as in claim 3, wherein the second electric motor drive is operably disposed within the rotary drum.

5. The drum inter-storage as in claim 1, wherein the rotary drum comprises an inlet portion and a central portion, and an integrated draw-off roller fitted upstream of the inlet portion in a direction of yarn travel, an outer diameter of the draw-off roller corresponding to an outer diameter of the central portion of the rotary drum such that working surfaces of the draw-off roller and central portion of the rotary drum have essentially the same circumferential speed.

6. A drum inter-storage for yarn in a textile machine, wherein the drum inter-storage is operably disposed between a yarn draw-off mechanism and a yarn winding device for controlling yarn tension during winding, the drum inter-storage comprising:

a driven rotary drum coupled to a first electric motor drive;

a compensatory rotary arm coupled to a second electric motor drive, the compensatory rotary arm disposed to rotate and wrap drawn-off yarn around the driven rotary drum with a specific force to obtain a desired tension in the drawn-off and wound yarn;

the first electric motor drive controlled by a control system and the second electric motor drive independently controlled by the control system such that the compensatory rotary arm is independently rotatable with respect to direction and speed of rotation relative to the driven rotary drum;

wherein the second electric motor drive is a brushless motor with permanent magnets; and wherein the brushless motor with permanent magnets comprises an encoder that generates an output indicating motor rotor position and rotational speed.

7. A drum inter-storage for yarn in a textile machine, wherein the drum inter-storage is operably disposed between a yarn draw-off mechanism and a yarn winding device for controlling yarn tension during winding, the drum inter-storage comprising:

a driven rotary drum coupled to a first electric motor drive;

a compensatory rotary arm coupled to a second electric motor drive, the compensatory rotary arm disposed to rotate and wrap drawn-off yarn around the driven rotary drum with a specific force to obtain a desired tension in the drawn-off and wound yarn;

the first electric motor drive controlled by a control system and the second electric motor drive independently controlled by the control system such that the compensatory rotary arm is independently rotatable with respect to direction and speed of rotation relative to the driven rotary drum; and wherein the rotary drum is mounted on a non-rotating central shaft;

a stator of the second electric motor drive is mounted at an end of the non-rotating central shaft, with a rotor of the second electric motor drive carried in the second electric motor drive stator;

a rotatable shaft attached to the rotor of the second electric motor and extending coaxially into the non-rotating central shaft;

the rotary arm coupled to an end of the rotatable shaft;

the first electric drive motor arranged on the non-rotating central shaft, wherein the rotary drum is mounted on a rotor of the first electric drive motor.

8. A drum inter-storage for yarn in a textile machine, wherein the drum inter-storage is operably disposed between a yarn draw-off mechanism and a yarn winding device for controlling yarn tension during winding, the drum inter-storage comprising:

a driven rotary drum coupled to a first electric motor drive;

a compensatory rotary arm coupled to a second electric motor drive, the compensatory rotary arm disposed to rotate and wrap drawn-off yarn around the driven rotary drum with a specific force to obtain a desired tension in the drawn-off and wound yarn;

the first electric motor drive controlled by a control system and the second electric motor drive independently controlled by the control system such that the compensatory rotary arm is independently rotatable with respect to direction and speed of rotation relative to the driven rotary drum; and the control system further comprising:

a command and communication unit;

a first module in communication with the first electric drive motor to control speed of rotation of the rotary drum, the first module in communication with the command and control unit;

a second module in communication with the second electric drive motor, the second module in communication with the command and control unit;

the second electric drive motor configured with an encoder in communication with the command and control unit for control of torque and speed of the rotary arm by the command and control unit; and the command and communication unit in communication with a central control system of the textile machine.

9. The drum inter-storage of claim 8, wherein the control system is equipped with a control program having program blocks for controlling speed of rotation of the rotary drum and for controlling speed and torque of the rotary arm.

* * * * *